United States Patent [19]

Benn

[11] 3,971,465

[45] July 27, 1976

[54] SELF-SCANNING ELECTROSTATIC PRINT HEAD FOR A DOT MATRIX PRINTER

[75] Inventor: Robert E. Benn, Broomall, Pa.

[73] Assignee: Burroughs Corporation, Detroit, Mich.

[22] Filed: Nov. 27, 1974

[21] Appl. No.: 527,909

[52] U.S. Cl. ..... 197/1 R; 101/DIG. 13; 313/217

[51] Int. Cl.[2] ..... B41J 3/18

[58] Field of Search ..... 197/1 R; 101/DIG. 13; 313/217, 220; 315/169 TV, 169 R

[56] References Cited

UNITED STATES PATENTS

| | | | |
|---|---|---|---|
| 2,944,147 | 7/1960 | Bolton | 101/DIG. 13 |
| 3,411,932 | 11/1968 | Malone et al. | 101/DIG. 13 |
| 3,545,378 | 12/1970 | Childress | 101/127 |
| 3,648,093 | 3/1972 | Kupsky | 313/217 |
| 3,673,461 | 6/1972 | Eisenberg | 315/169 TV |
| 3,683,364 | 8/1972 | Holz et al. | 313/220 X |
| 3,699,376 | 10/1972 | Caras | 313/197 |
| 3,821,586 | 6/1974 | Ogle | 313/217 X |
| 3,846,669 | 11/1974 | Glaser et al. | 315/169 R |

*Primary Examiner*—Ralph T. Rader
*Attorney, Agent, or Firm*—Richard Jordan; Leonard C. Brenner; William B. Penn

[57] ABSTRACT

An electrostatic dot matrix printer includes a print head utilizing a self-scanning ion charge transfer system to reduce the number of dot drivers and the operating potential required for electrostatic printing. In the print head, ionization is transferred from a set of scanning anodes to a set of apertured cathodes in a cyclical aperture-by-aperture fashion. In synchronism with the cylical transfer a selected pattern of ionization is transferred from the apertured cathodes, to a set of printing anodes. The selected pattern of ionization is further transferred to a portion of electrostatic paper by a planar electrode, thereby depositing a selectively determined charge pattern on the electrostatic paper.

9 Claims, 4 Drawing Figures

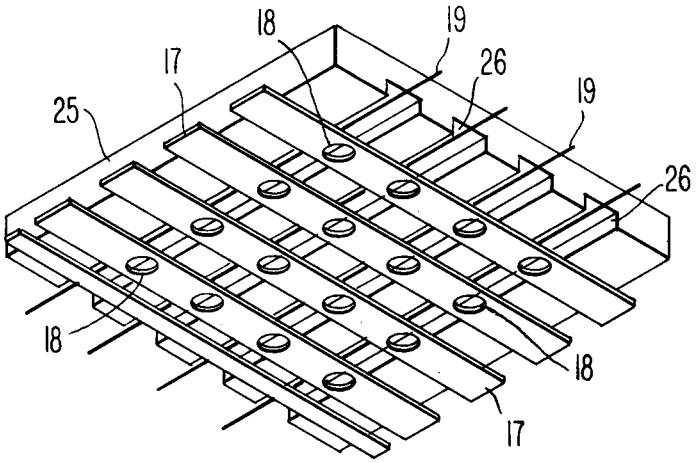
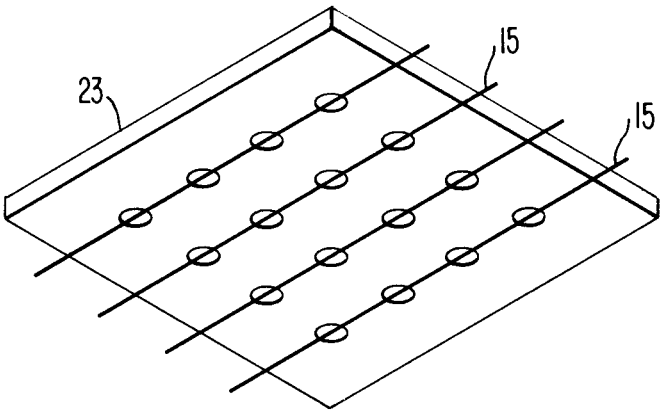
Fig. 1
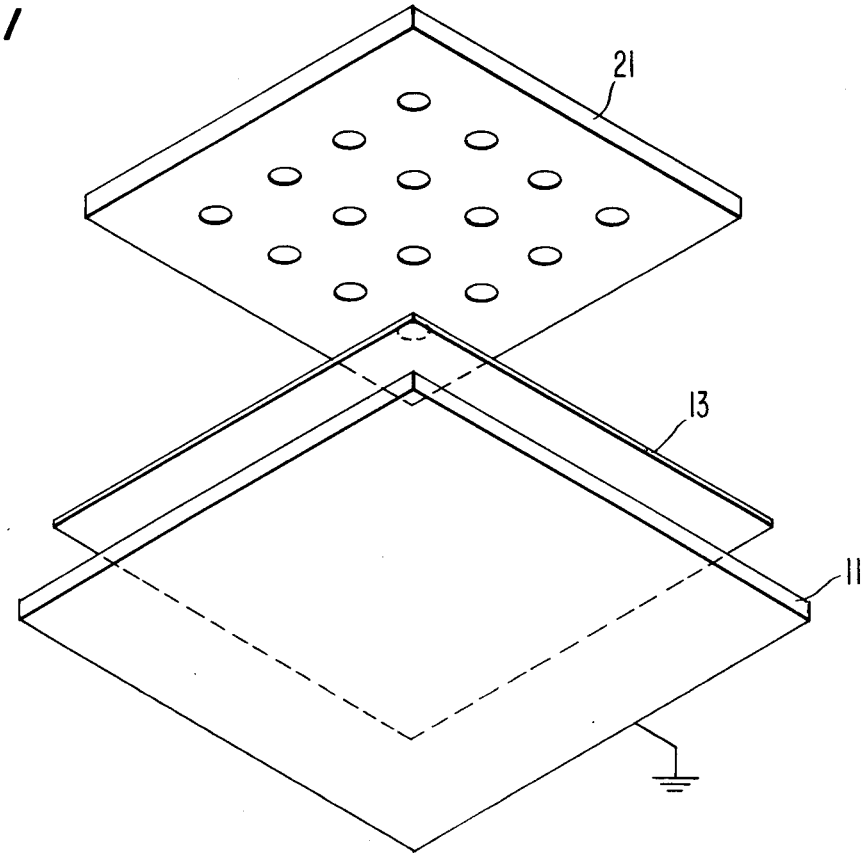

SELF-SCANNING ELECTROSTATIC PRINT HEAD FOR A DOT MATRIX PRINTER

BACKGROUND OF THE INVENTION

Electrostatic dot matrix printing techniques developed through the prior art generally comprise three basic steps. First, electrostatic charges are placed on the surface of a high resistivity paper having a thermoplastic coating by applying voltage pulses to electrodes of desired configuration positioned near the paper, the pulses having magnitudes in the order of 1,000 volts and durations in the microsecond range. Second, the electrostatic charges which form a latent electrostatic image on the high resistivity paper are made visible by passing the paper through a bath of dry inking powder which adheres to the charged area. Third, the ink powder is permanently bonded to the copy by heating the thermoplastic coating on the paper to its softening point and having the ink lightly pressed into it.

Although much progress has been made in the inking and permanent bonding steps, many problems yet remain in the initial charge forming process. The dot matrix type electrostatic printer of the prior art generally requires at least one transistor or other solid state driver device operating in or near the 1,000 volt range for the generation of each dot in the matrix. This requirement for a large number of drivers operating under high potential stress has resulted in a costly printer having poor reliability and has contributed to limiting the commercial success and applicability of the electrostatic printer.

It is known in the display panel art that ion discharge paths may be sustained and deviated or transferred at lower voltage potentials than those required to initiate the ionization paths in the first place. Effective use of this transfer phenomenon to reduce driver constraints have been made in the display panel field as disclosed in U.S. Pat. Nos. 3,617,796, 3,648,093, 3,673,461, 3,699,376, and 3,846,669, all assigned to the assignee of the present invention. Further use of the ionization transfer phenomenon in the panel display field is described in the article "Dot Matrix Display Features Inherent Scanning Ability", ELECTRONICS, March 1970, pp. 120–125. However, within the knowledge of applicant, the ionization transfer phenomenon has not yet been effectively harnessed for use in an electrostatic printer.

SUMMARY OF THE INVENTION

It is therefore an object of this invention to provide a reliable and economical electrostatic printer.

It is another object of this invention to provide a dot matrix printer requiring significantly less than one driver per dot.

It is still another object of this invention to provide a high reliability dot matrix printer utilizing an ionization transfer system with operation at relatively reduced potentials.

Accordingly, the electrostatic dot matrix printer of the present invention utilizes a charge transfer scanning system to impress a selectible charge pattern upon the surface of a portion of electrostatic paper backed by a planar electrode. Juxtaposed to the front surface of the paper is a print head having a set of flat apertured linear cathodes sandwiched between two sets of linear wire anodes, all sets lying in planes parallel to the paper, with the cathodes orthogonal to the anodes and the cathode apertures aligned with each apparent cathode-anode intersection. The set of anodes furthest from the paper, the scanning set, are cyclically energized with respect to the cathodes to form a continuous ionization self-scanning pattern therebetween. The other or printing set of anodes are selectively energized with respect to the cathodes in synchronization with the cyclical energization to generate a desired pattern of charges between the cathodes and the printing anodes. The pattern may represent, for example, an alphanumeric character. The pattern formed between the cathodes and the printing anodes is attracted to the paper by the planar anode backing the electrostatic paper thereby impressing a charge pattern upon the paper. The electrostatic printer may be enclosed in a controlled atmospheric environment such as reduced pressure neon gas to closely define and control ionization potentials and ion charged transfer characteristics.

DESCRIPTION OF THE DRAWING

Other objects, features and advantages of this invention will be readily apparent and better understood by reference to the following detailed description when considered in conjunction with the appended claims and the accompanying drawings in which:

FIG. 1 is an exploded view of a dot matrix electrostatic printer embodying the invention;

DETAILED DESCRIPTION OF THE PREFERRED EMBODIMENT

Figure 2:
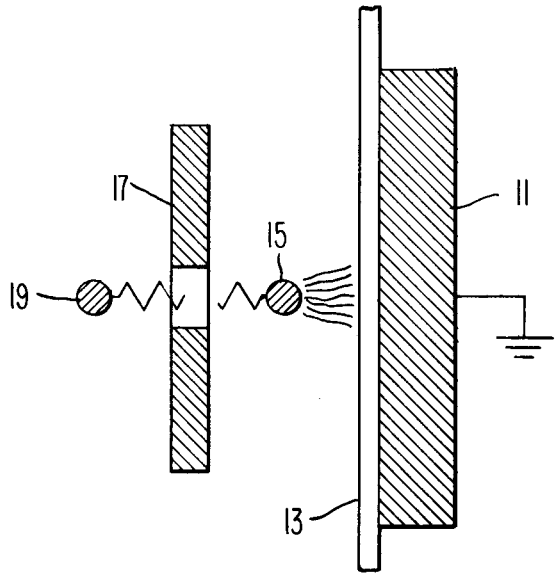
FIG. 2 is a side view of a single dot generator of the printer shown in FIG. 1.

Referring now to FIG. 1, there is shown an exploded view of a dot matrix electrostatic printer arranged for self-scanning operation having a planar electrode 11 supporting a portion of electrostatic paper 13. Juxtaposed above and parallel to the front surface of the paper 13 is a first set of parallel linear thin wire anodes 15, hereinafter referred to as the printing anodes 15. Further from the paper 13 is a set of apertured rectangular cathodes 17 aligned parallel to the paper 13 and perpendicular to the printing anodes 15. The cathode apertures 18 are centered around the apparent intersections of cathodes 17 and anodes 15 as seen by one directly viewing the front surface of the paper 13. Above the set of cathodes 17 is a second set of linear thin wire anodes 19 hereinafter referred to as the scanning anodes 19, aligned parallel to the printing anodes 15.

The size of the rectangular matrix formed by the set of cathodes 17 and the sets of anodes 15 and 19 is determined by specific printer requirements. For example, in the line printer embodiment, the matrix is fashioned to print a single line of print. In alternate embodiments the matrix may be sized to print a single alphanumeric character, a plurality of alphanumeric characters, or a complete sheet of alphanumeric characters.

As shown in FIG. 1, the print head also includes a front apertured panel 21 interposed between the electrostatic paper 13 and the printing anodes 15, an intermediate apertured panel 23 interposed between the printing anodes 15 and the apertured cathodes 17, and an aft panel 25 atop the apertured cathodes 17, the aft panel having a plurality of slots 26 for receiving the scanning anodes 19. The panels combine to give strength and support to the print head arrangement, to separate the anodes and cathodes, and to confine ionization formed between the anodes and cathodes into non-spreading paths or cells. Suitable panel fabrication methods are discussed in the above-cited U.S. Pat. Nos. 3,617,796, 3,648,093 and 3,699,376 relating to the display panel art. In the print head of the present invention the panels are non-conducting and may be either transparent or non-transparent. Also, in the present invention, the front panel 21 is apertured to permit ionization transfer between the printing anodes 15 and the planar electrode 11.

The basic operational principles of the dot matrix print head for a single aperture 18 is shown in FIG. 2. An ion discharge is established between the scanning anode 19 and the cathode 17 by creating a sufficient potential differential therebetween. Sufficient voltage is then applied to the printing anode 15 to draw the ion charge through the apertured cathode 17. It has been found that the voltage potential required to draw ionization charge through an apertured cathode to an anode is lower than that which would be required to initiate ion discharge without the aid of a "priming" charge. The dynamics of charge transfer cannot be described with exact certainty. However, as explained in U.S. Pat. No. 3,654,508, the transfer process may involve actual transfer of a mass of ionized gas, or diffusion of excited particles including metastable states or both.

Once a discharge is established to the printing anode 15 it is drawn to the surface of the electrostatic paper 13 by a potential on planar electrode 11. Normally, for safety reasons, the planar electrode 11 is grounded and all other potentials are referenced accordingly.

The charged dot formed on the electrostatic paper 13 may subsequently be affixed as a permanent visible dot by standard electrostatic processing techniques.

As specific printing embodiments require, the electrostatic paper 13 may be automatically or manually placed on the planar electrode 11 sheet-by-sheet or fed over the electrode 11 in the form of a continuous web.

Figure 3:
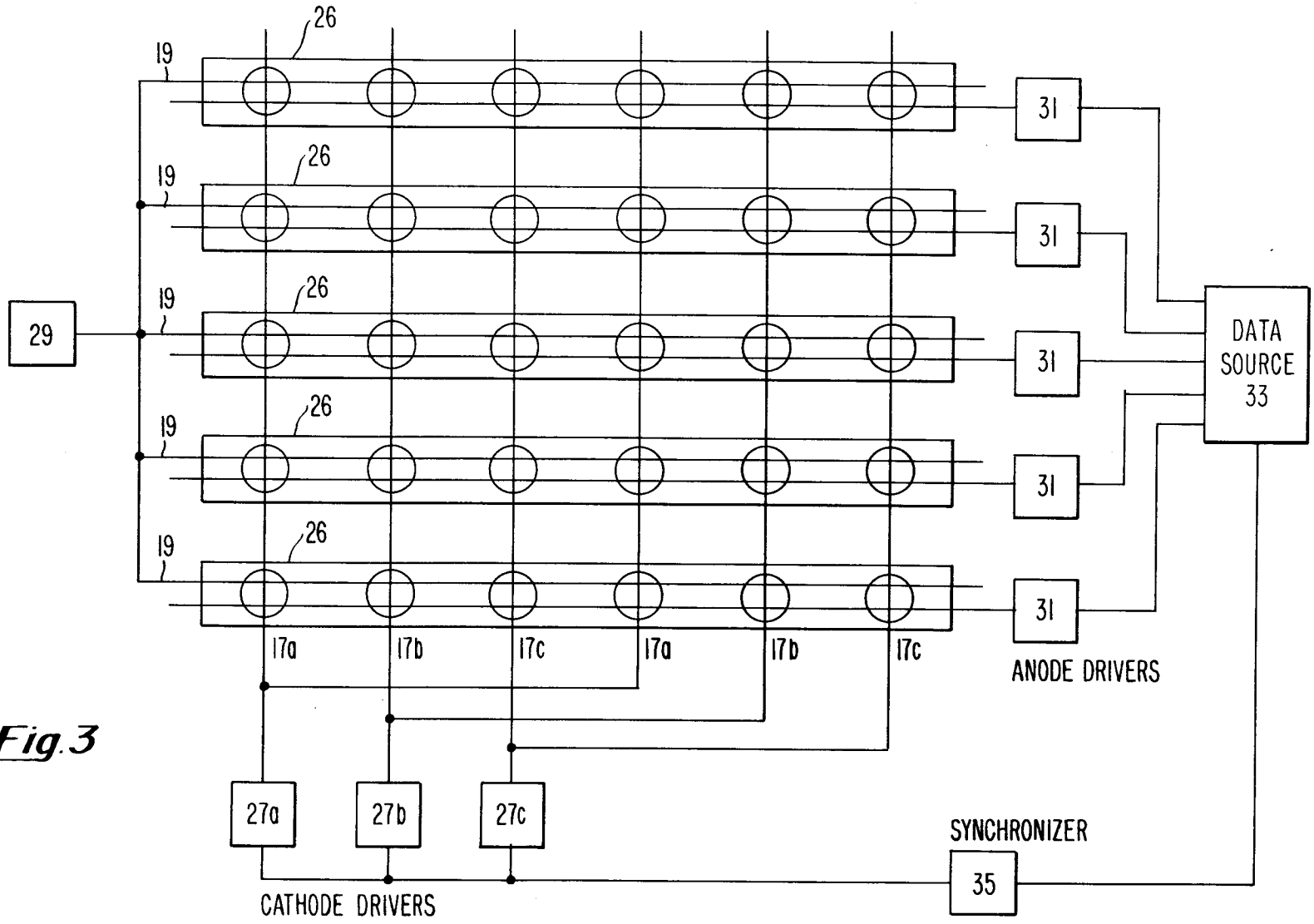
FIG. 3 is a wiring schematic for a three-phase ionization transfer system used in the invention.

Methods of combining several cathodes and anodes in a rectangular matrix to form a self-scanning ion discharge system as shown in FIG. 3 are described in detail with regard to display panel applications in U.S. Pat. Nos. 3,673,461 and 3,846,669 and in the above-cited article by William J. Horman in ELECTRONICS, Mar. 2, 1970, pp. 120–125.

Briefly, with reference to FIG. 1 and particularly FIG. 3, the apertured cathodes 17 are connected in groups with, in one arrangement, every fourth cathode being in a group. Thus, cathodes 17*a* are in a group, 17*b* are in a group, and 17*c* are in a group, and each group is connected to its own drive circuit 27 (*a*, *b*, *c*) for applying operating potential thereto. All of the scanning anodes 19 are connected together to a common anode operating potential source 29. Each printing anode 15 is connected to its own potential source 31, all of which are coupled to and are operated by singals from an information signal source 33 which may represent a computer, encoder, decoder, character generator or other required circuitry. Synchronizer 35 provides the phasing signals to perform the operation described below.

With all scanning anodes 19 energized, the cathode drivers 27 are each energized in turn and ionization occurs between the scanning anodes 19 and the cathode 17 closest to the most recently energized cathode 17 causing ionization. In this manner, the scanning anode-cathode ionization is transferred cathode-by-cathode as the cathodes 17 are energized in cyclic fashion. Slots 26 in aft panel 25 permit excited particles to diffuse from an ionized scanning anode 19-cathode 17 array to the adjacent scanning anode 19-cathode 17 array thereby priming the adjacent array and causing ionization to occur when the associated cathode 17 is energized even though a more remote array will not be ionized when its associated cathode 17 is simultaneously energized.

As the cathodes 17 are cyclically energized, synchronized operating potentials are applied to the printing anodes 15 in accordance with information signals received from data source 33 to selectively transfer the ionization sustained between the scanning anodes 19 and the cathodes 17 to the printing anodes 15 to form a pattern of ionization as determined by the data source 33. The ionization pattern attracted to the printing anodes 15 is further attracted to the planar electrode 11 by the potential impressed thereupon thereby depositing a charge pattern on the electrostatic paper 13. The scanning cycle described above need be performed only once for each charge pattern to be deposited, for pattern refreshment, a requirement in many display systems, is not needed in electrostatic printing since the electrostatic paper functions as a memory in storing the charge pattern.

Figure 4:
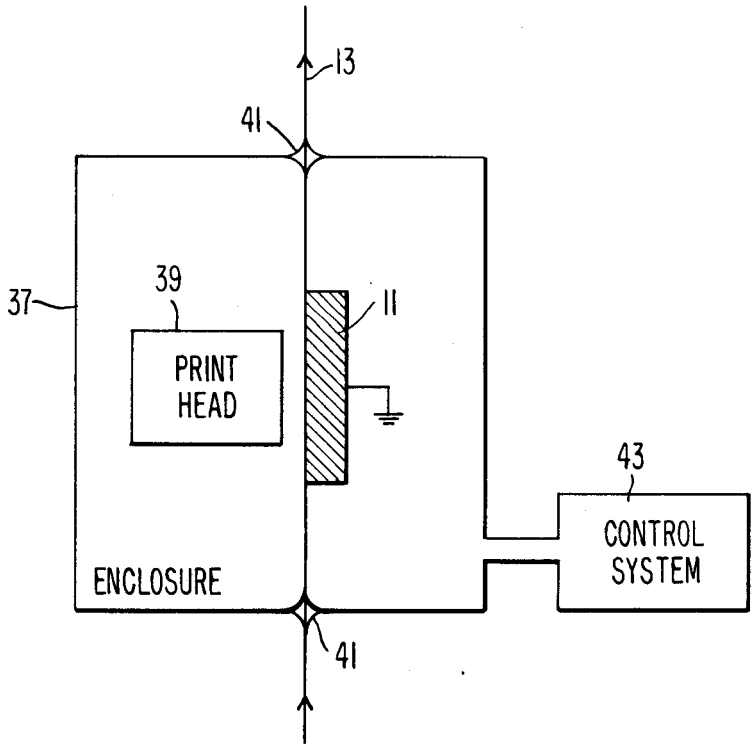
FIG. 4 is a side view of a dot matrix printer embodying the invention in an enclosed environment.

The electrostatic print head of the subject invention as above-described, may operate in a room ambient environment. In an alternate embodiment, see FIG. 4, the entire print head system is encased in a closed environmental system capable of operating at reduced atmospheric pressure and including a specialized gas atmosphere, such as neon, to more closely define ionization potentials and ion charge transfer characteristics. An enclosure 37 completely encases the print head 39 of the subject invention including the planar electrode 11. Wipers 41 are provided so that the electrostatic paper 13, preferably of continuous web form, may enter and exit the enclosure 37 with minimum environment contamination and leakage. An environmental control system 43 reduces the gas pressure within the enclosure 37 and provides preferably a neon gas mixture for increased electrostatic printing reliability and stability.

Those skilled in the art will appreciate that further modifications may be made in practicing the invention. For example, in printing applications where ionization spreading is not a major concern, the front apertured panel 21 may be eliminated. Also, in other situations, the thin wire printing anodes 15 may be replaced with flat apertured electrodes similar to those used as the cathodes 17. Furthermore, in view of the above teachings, the scanning anodes 19 may be adpated for raster scanning as described in U.S. Pat. No. 3,846,669.

Other changes and modifications of the described arrangements may be needed to fit particular operating requirements. These changes and modifications, insofar as they are not departures from the true scope of the present invention, are intended to be covered by the claims appended hereto.

What is claimed is:

1. In an electrostatic printer, a dot matrix electrostatic print head system for cyclically generating a continuous self-scanning ionization pattern, generating therefrom a selective ionization pattern in synchronization with the self-scanning pattern, and depositing the selective ionization pattern onto electrostatic paper, the print head system comprising:

a planar electrode for supporting the back of electrostatic paper;

a set of parallel printing anodes in a plane juxtaposed in parallel to the front surface of the electrostatic paper a set of apertured parallel cathodes in a plane juxtaposed in parallel to the front surface of the electrostatic paper, the cathode plane being further removed from the paper than the printing anode plane, said set of cathodes being orthogonal to said set of printing anodes, and the cathode apertures being aligned with the apparent intersections of said set of cathodes and said set of printing anodes;

a set of parallel scanning anodes in a plane juxtaposed in parallel to the front surface of the electrostatic paper, the scanning anode plane being further removed from the paper than the cathode plane, said set of scanning anodes being parallel to said set of printing anodes and aligned with the apertures in said set of apertured cathodes;

scanning means for cyclically transferring aperture-by-aperture ionization between said set of scanning anodes and set of apertured cathodes;

selective pattern generating means synchronized with said scanning means for selectively transferring a pattern of ionization through the apertures in said set of cathodes to said set of printing anodes; and potential referencing means cooperating with said planar electrode for attracting the selective ionization pattern from said printing anodes through the electrostatic paper to said planar electrode thereby causing the selective pattern to be deposited on the electrostatic paper.

2. The dot matrix electrostatic print head system according to claim 1 wherein said means for selectively transferring includes:

a printing anode driver individually associated with each anode in said set of printing anodes; and an information signal source connected to all said printing anode drivers for selectively energizing the printing anodes in said set of printing anodes.

3. The dot matrix electrostatic print head system according to claim 1 wherein:

said set of parallel printing anodes and said set of parallel scanning anodes each comprise a set of thin wire electrodes.

4. The dot matrix electrostatic print head system according to claim 1 wherein said potential referencing means includes means for electrically grounding said planar electrode.

5. The dot matrix electrostatic print head system according to claim 1 wherein said scanning means includes:

a scanning anode power source providing potential in common to all scanning anodes in said set of scanning anodes;

a coupling circuit for electrically interconnecting said cathodes into groups;

a cathode driver individually associated with each group of cathodes; and energizing means for cyclically powering said individually associated cathode drivers.

6. The dot matrix electrostatic print head system according to claim 5 wherein said coupling circuit forms three groups of cathodes.

7. The dot matrix electrostatic print head system according to claim 1 further including a closed environmental system for housing said planar electrode, said set of printing anodes, said set of cathodes and said set of scanning anodes in an atmosphere of a preselected gas at low pressure, said closed environmental system comprising:

an environmental control enclosure encasing said planar electrode, said set of printing anodes, said set of cathodes, and said set of scanning anodes;

a pair of wipers secured to said enclosure for permitting the electrostatic paper to enter and exit said enclosure with minimum environmental contamination or leakage; and an environmental control system for supplying an atmosphere of low pressure neon gas to said environmental control enclosure.

8. In an electrostatic printer, a dot matrix electrostatic print head for cyclically generating a continuous self-scanning ionization pattern and generating therefrom a selective ionization pattern in synchronization with the self-scanning pattern, the selective pattern then being deposited onto electrostatic paper, said print head comprising:

an apertured front non-conducting panel;

an apertured intermediate non-conducting panel; and an aft slotted non-conducting panel, all panels being sealed together along their peripheries;

a set of parallel scanning anodes disposed between said aft panel and said intermediate panel;

a set of parallel printing anodes disposed between said front panel and said intermediate panel, each printing anode being parallel to and individually aligned with a scanning anode in said set of scanning anodes;

a set of cathodes embedded in said center panel and orthogonally positioned to said scanning and printing anodes, said set of cathodes including apertures for providing an ionization communication path from each scanning anode to its individually aligned printing anode;

scanning means for cyclically transferring aperture-by-aperture ionization between said set of scanning anodes and said set of apertured cathodes; and selective pattern generating means synchronized with said scanning means for selectively transferring a pattern of ionization through the apertures in said set of cathodes.

9. In an electrostatic printer, a dot matrix electrostatic print head system for cyclically generating a continuous self-scanning ionization pattern, generating a selective ionization pattern in synchronization with the self-scanning pattern, and depositing the selective pattern onto electrostatic paper, said print head system comprising:

a set of apertured parallel cathodes;

means for cyclically transferring ionization aperture-by-aperture to said cathodes;

scanning means for driving said cyclically transferring means;

means synchronized with said scanning means for selectively transferring ionization from said cathodes; and means for attracting said selectively transferred ionization to the electrostatic paper, thereby depositing a selectively determined charge on the electrostatic paper.

* * * * *